United States Patent [19]

Hughes et al.

[11] 4,123,894

[45] Nov. 7, 1978

[54] SEALED WIRE ROPE

[75] Inventors: Charles R. Hughes, Hellertown; Darral V. Humphries, Allentown, both of Pa.

[73] Assignee: Bethlehem Steel Corporation, Bethlehem, Pa.

[21] Appl. No.: 822,190

[22] Filed: Aug. 5, 1977

[51] Int. Cl.[2] ..... D07B 1/16; D02G 3/36

[52] U.S. Cl. ..... 57/220; 57/221; 428/378; 428/380; 428/400; 57/7; 57/13; 57/907

[58] Field of Search ..... 57/149, 153, 162, 164; 428/375, 377, 378, 380, 400

[56] References Cited

U.S. PATENT DOCUMENTS

| | | | |
|---|---|---|---|
| 2,518,454 | 8/1960 | Elliott | 260/724 |
| 2,985,056 | 5/1961 | Greve | 57/149 X |
| 3,639,567 | 2/1972 | Hervig | 264/45 |
| 3,681,911 | 8/1972 | Humphries | 57/149 |
| 3,705,489 | 12/1972 | Smollinger | 57/149 |
| 3,761,346 | 9/1973 | Caroselli et al. | 57/164 X |
| 3,778,994 | 12/1973 | Humphries | 57/149 |
| 3,800,522 | 4/1974 | Hughes et al. | 57/149 |
| 3,824,777 | 7/1974 | Riggs | 57/149 |
| 3,874,158 | 4/1975 | Chiappetta et al. | 57/149 |
| 3,979,896 | 9/1976 | Klett et al. | 57/149 |

*Primary Examiner*—Charles Gorenstein

*Attorney, Agent, or Firm*—Joseph J. O'Keefe; Charles A. Wilkinson

[57] ABSTRACT

A corrosion resistant rope in which the individual strands are sealed with a plastic foam impregnant and which exhibits excellent retention of lubrication is made by preimpregnating the outer strands of the rope with plastic foam material prior to closing the strands into a wire rope. The final rope may then be surface lubricated to provide temporary and long term corrosion resistance and lubrication to exposed surface wires.

10 Claims, 10 Drawing Figures

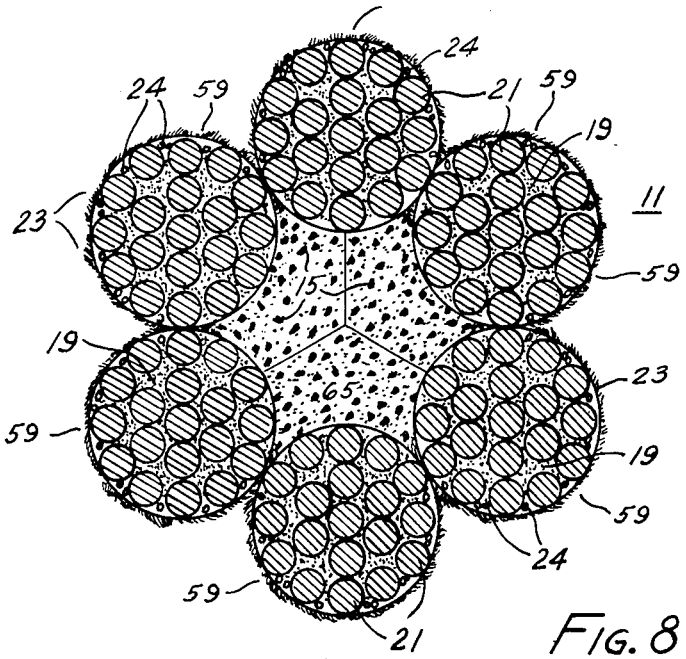
FIG. 8
FIG. 2A
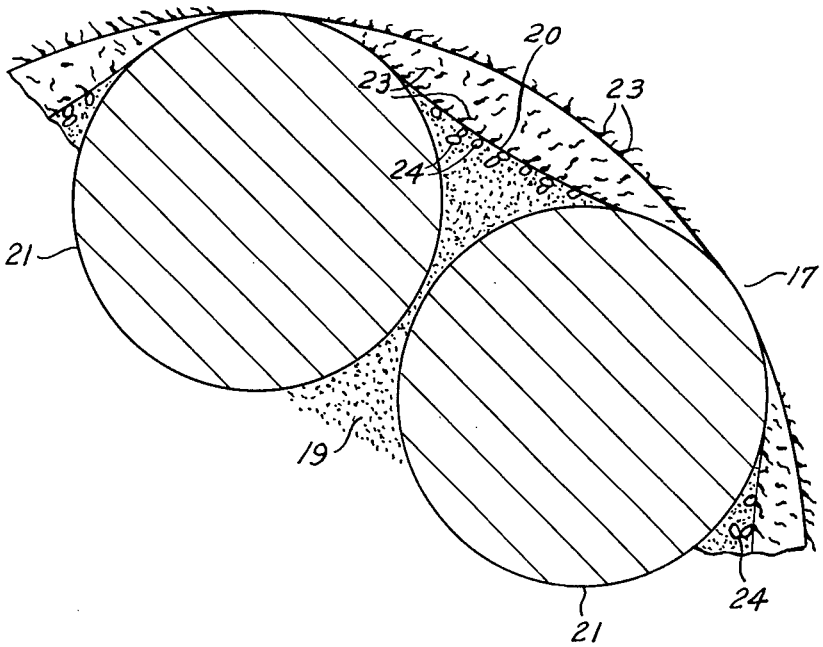

SEALED WIRE ROPE

BACKGROUND OF THE INVENTION

This invention relates generally to the protection of wire ropes from corrosive conditions and more particularly to the sealing of wire ropes against corrosive environments by the use of plastic foam compositions.

Various expedients have in the past been used to bar the entrance of water and moisture into the interior of wire ropes and strands. Such expedients have included the use of heavy lubricants, external plastic coatings and the encapsulation of individual wires, strands or even an entire wire rope in solid plastic sheaths. Lubricants are soon lost from an otherwise unprotected strand or rope while external protective coatings are subject to wear and upon rupture at any point will admit moisture to the interior of the rope or strand. Solid encapsulation, on the other hand, seriously interferes with the flexibility of the rope or strand and is also difficult to attain.

U.S. Pat. Nos. 3,681,911 and 3,778,994 to D. V. Humphries and 3,800,522 to C. R. Hughes et al. as well as several other recently issued patents disclose a successful alleviation of many of these previous problems. In these disclosures a working wire rope or a single working strand is impregnated with a liquid plastic foam composition during fabrication and said liquid is then converted to a flexible foam by the application of heat. The foam material is adherent to the individual wires and because of its low overall density does not decrease the flexibility of the rope or strand. The exterior of the rope or strand may be covered with a thin layer of foam or with a layer of denser plastic or may more preferably be wiped clean, particularly in working ropes and strands, i.e. those which are used over sheaves and pulleys and the like or otherwise used in dynamic operations as opposed to static use such as guy lines and other types of permanent anchor lines. The bare wire surfaces resist abrasion and wear in these cases while the interior foam material between the wires, which preferably closely encloses all but the outer surfaces of the wires, prevents the access of water and moisture to the interior surfaces of the wires.

While these previous wire ropes and strands have been very successful, there are some applications in which it may not be desired to fully impregnate a wire rope with plastic. For example, in some installations it may be desired to make use of a permanently lubricated wire core or fiber core in a rope. Methods of completely or partially encapsulating a lubricant permanently in a wire rope core are disclosed to U.S. Pat. Nos. 3,705,489 to C. W. Smollinger, 3,824,777 to P. P. Riggs and 3,874,158 to F. Chiapetta et al. Where it is desired to use a natural or synthetic fiber core in a wire rope, it has often been found to be impractical to encapsulate all of the outer strands with a plastic foam and then heat cure the assembly all at one time because the heat of the foaming operation deleteriously affects the properties of the fiber core. Most experimental plastic foam impregnated wire ropes have, therefore, been made with the individual strands of the rope impregnated with plastic foam prior to stranding, or closing, of the individual strands together into a rope. In these experimental ropes the core of the rope has been a lubricated fiber core, but lubricated wire rope cores have also been used.

It is often desirable even in plastic foam filled ropes to prelubricate the surface of the strand with a heavy lubricant such as a heavy grease or asphalt composition which serves to protect the outer exposed surfaces of the wires from the environment prior to and during use and also serves during use to lubricate the surface of the rope. Frequently a reel of wire rope will be retained in very corrosive environmental conditions for long periods prior to and in between use. For example, a so-called shrimp rope for use on shrimp boats may remain on a reel in marine environments for several weeks or more prior to use and for shorter intermittent periods during use. While a plastic foam impregnated wire rope will be inherently quite corrosion resistant, as compared with an unimpregnated rope, portions of the outer wires will usually still be exposed and subject to corrosion which may tend to migrate even under the edges of the plastic as corrosion products such as rust lift the edges of the plastic. It has been found, therefore, that it is often desirable to apply the usual outer heavy lubrication ordinarily applied to conventional ropes under such conditions to the foam plastic impregnated ropes as well. Naturally it is desirable for such lubrication to remain on the surface of the rope as long as possible, both for lubrication during use and for corrosion protection.

BRIEF SUMMARY OF INVENTION

It has been unexpectedly found that where the outer strands of a wire rope are preimpregnated with plastic foam material and the strands then closed or stranded into a rope and the outer portions covered with a lubricant, that due to the excellent surface properties of the foam filled strand, the external lubricant is retained very significantly longer than a similar lubricant on a conventional wire rope. While the reason for such improved adhesion is not completely understood it has been observed that the surface of such ropes is uneven and of a porous nature with loose uneven fibers protruding from the surface, apparently due to a shredding and abrasion action upon the exterior of the plastic foam material adjacent to the surface of the strands during the closing of the strands into the rope. Small but definite pores or pockets can be detected in the surface of the foam plastic and just below the surface. It is theorized that the combined porous and fibrous character of the surface is effective to significantly increase the overall retention of a surface lubricant upon the rope.

It has also been unexpectedly found that the peculiar surface properties of the individual foam impregnated strands after closure into a rope serves very effectively to maintain a tight seal between adjacent outer strands of the wire rope, which seal will prevent loss of lubricant from a central fiber core or lubricated wire core of a rope having a lubricated central core. Such central core may comprise a lubricated fiber core, a lubricated wire strand core or an independent wire rope core, commonly referred to as an IWRC. While the exact reason for the excellent sealing between the outer strands is again not definitely known, it is believed that the rough, porous, fibrous character of the surface of the foam filled outer wire strands of the rope after closing about the core serves to hold lubricant securely between the strands and prevent escape of the internal lubricant from the core of the wire rope. The rough fibrous character of the surface together with the lubricant very effectively seals all large openings between the outer strands and seals the internal lubricant inside the rope.

BRIEF DESCRIPTION OF THE DRAWINGS

FIG. 2A is an enlarged view of a portion of FIG. 2 more clearly showing the characteristics of the surface of the foamed plastic after the closing operation.

FIG. 8 is a cross sectional view of a still further embodiment of the invention.

DESCRIPTION OF THE PREFERRED EMBODIMENTS

Figure 1:
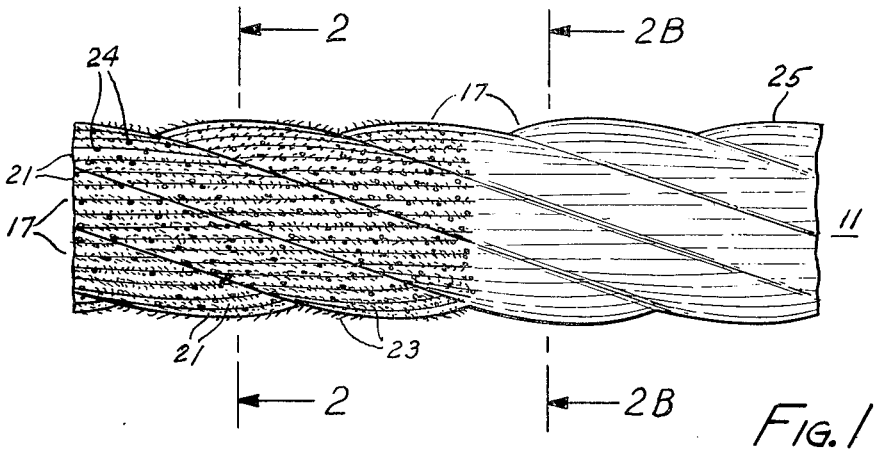
FIG. 1 is a longitudinal view of a rope made in accordance with the present invention showing the retentive surface before and after application of a surface lubricant.
Figure 2:
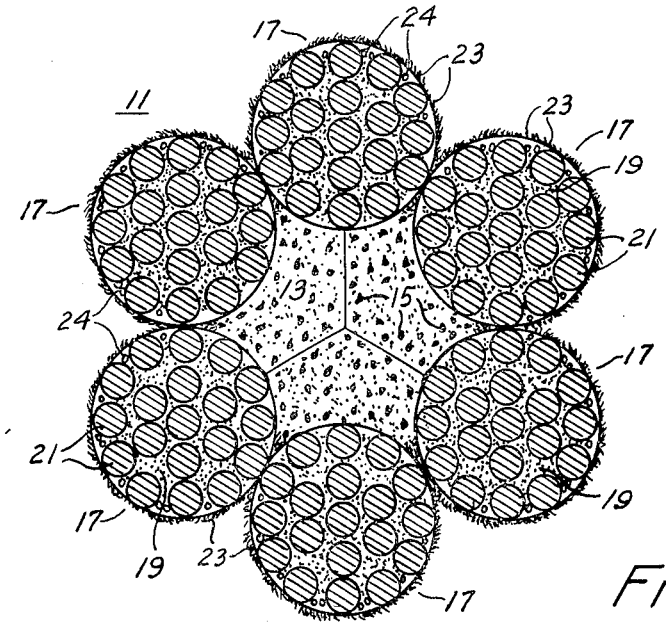
FIG. 2 is a cross sectional of the rope shown in FIG. 1 at 2—2 in FIG. 1.

In FIGS. 1 and 2 there are shown an elevation and a cross section respectively of a wire rope 11 made in accordance with the present invention. This rope has a central fiber core 13 formed of a twisted strand of polypropylene fibers impregnated with a heavy lubricating oil 15. Other conventional fibers such as the traditional sisal fibers or else synthetic fibers other than polypropylene may also be used. Surrounding the fiber core are six outer wire strands 17 each comprised of nineteen wires twisted together into a strand and closed about the outside of the central fiber core 13. The outer strands 17 are impregnated with a plastic foam material 19. The outer wires 21 of the strands 17 are substantially bare and the surface of the wires protrude slightly through the plastic foam except for a number of fibers 23 which protrude from the surface from between and to some extent over the individual wires. Between the substantially bare wires the surface of the foamed plastic material has in addition to the protruding fibers 23, a number of variously dimensioned small pores 24 opening to the surface and sometimes partially interconnected below the surface. While the foamed plastic is, of course, inherently porous the pores in the surface tend to be larger than the normal foamed porosity. Between the individual outer strands these pores 24 and fibers 23 are compressed between the strands and impregnated with heavy lubricant derived from the lubricated central core.

FIG. 2A is an enlarged view of a portion of FIG. 2 in which the conformation of the foamed plastic 19 between the outer wires 21 of an individual strand 17 can be more clearly seen. A slight depression in the plastic surface 20 between wires is visible. Under the surface 20 are pores 24 opening to the surface and in some cases interconnected with each other. Uneven fibers, or shreds of plastic, 23 protrude from the surface of the foam plastic. Since the strands 17 are spirally wound the background shows a more or less even circumference of plastic surmounted with the fibers 23 about the entire circumference of the strand.

Figure 2B:
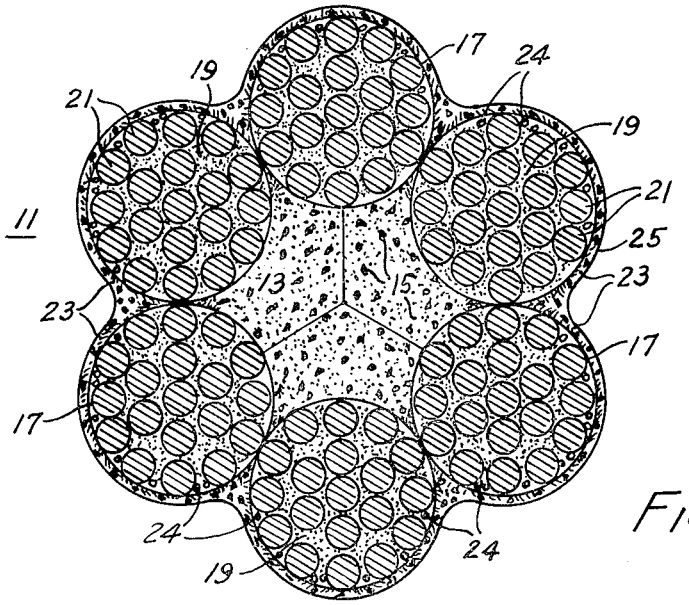
FIG. 2B is a cross sectional of the rope shown in FIG. 1 at 2B—2B, after the application of a heavy lubricating grease or oil to the outside of the strand.

In FIG. 2B a heavy outer layer of lubricant 25 has been applied to the outer surfaces of the outer strands as both a lubricant and corrosion inhibiting medium. The individual outer fibers 23 of the strand extend into this outer layer and are believed to prevent such lubricant layer from being dislodged from the surface by mechanical means and expecially by exposure to sea water and the like. The pores 24 in the surface of the foamed plastic material are also filled with lubricant and serve as small protected reservoirs of lubricant. The lubricant layer is very effective in preventing premature corrosion of the exposed outer surfaces of the outer wires of the outer strands, which wires are not coated with foam or other plastic in order to provide a good wear surface for passage over sheaves and the like.

Figure 3:
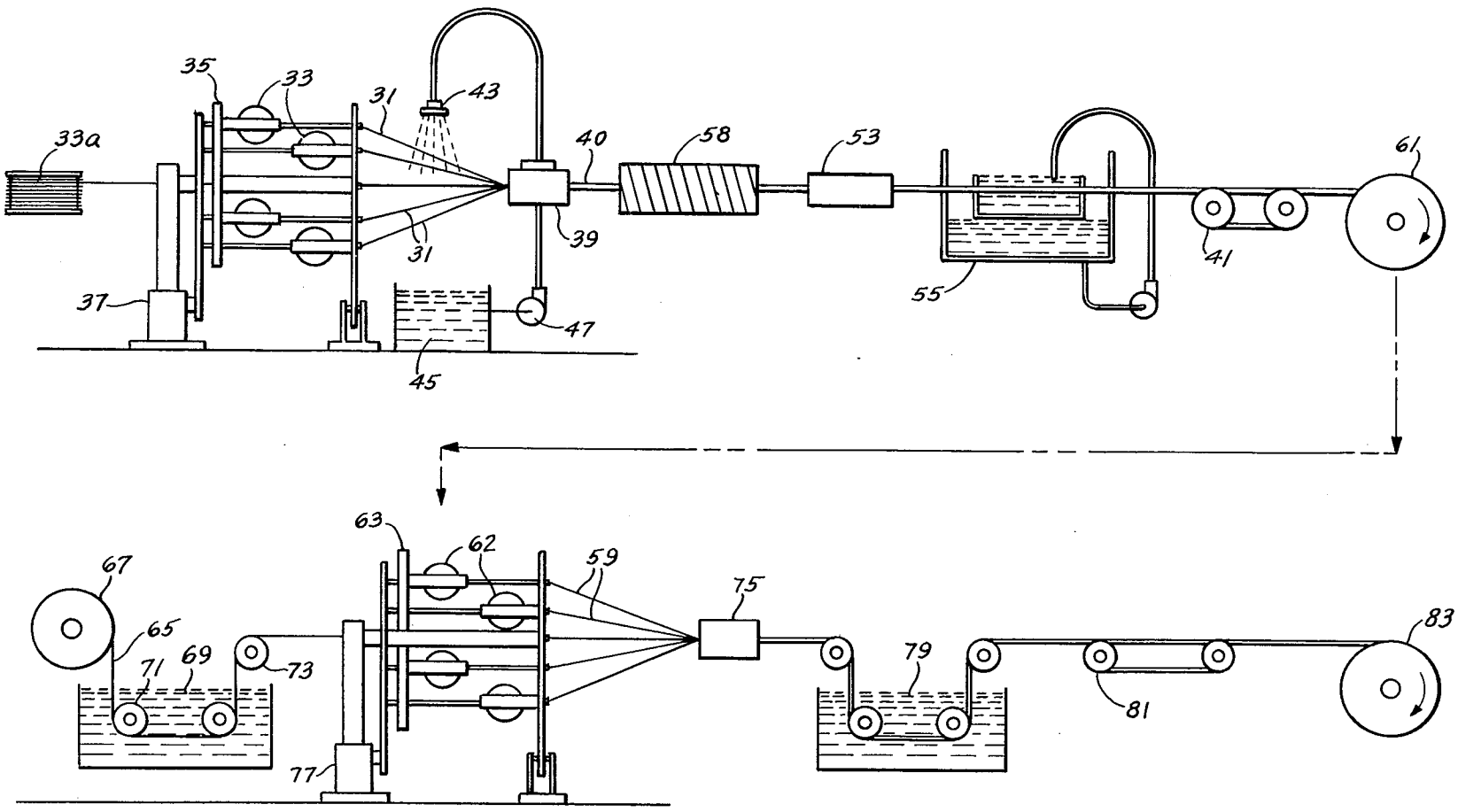
FIG. 3 is a schematic elevation of a manufacturing line for the making of the wire rope of the invention.

In FIG. 3 there is shown in schematic form an apparatus for making the rope shown in FIGS. 1, 2, 2A and 2B. A twisted wire strand is first made from a series of wires 31 held on a series of reels 33 all but one 33*a* of which are mounted on a rotatable flyer 35 driven by a motor 37. The individual wires 31 are passed from the rotating flyer during operation into a closing die 39 where the wires are closed into a twisted strand 40 which is then passed about a capstan 41 and onto a storage reel 61. Before passing into the closing die 39 the individual wires pass through a spray of a liquid foamable plastic composition which passes from a spray head 43 onto the wires 31. Excess foamable plastic falls into a reservoir 45 and is recirculated via pump 47 to the spray head 43. After passing through the closing die 39 and being formed into the twisted strand 40 the wires are exposed to heat in an induction furnace 58 where the foamable plastic material is foamed by the heat generated. This curing operation may be accomplished in line as shown or alternatively as a separate operation. After foaming the strand is passed through a rotating or stationary die, which will usually be a rubber or other elastomeric material die 53, which serves to wipe the outer surface of the strand so that only a very thin layer of densified plastic is left on the surface. The surface of the plastic material is still plastic and somewhat tacky in the elastomeric die 53 and although the plastic is below its heat distortion temperature it still exhibits poor tear strength. Consequently some shredding and tearing of the surface occurs which seems to accelerate and increase later shredding of the plastic surface when the individual strands are closed into a wire rope. The strand then passes through a weir type cooling trough 55 where the foamed plastic material is hardened and finally passes over the capstan 41 and onto the storage reel 61. All this is essentially as shown and claimed in the previous patents referred to above.

The plastic foam impregnated strand 59 on the reel 61 is next rewound on a series of bobbins 62 and mounted in a second flyer 63. A plastic fiber core strand 65 is taken from a reel 67 and passed down into a heavy oil bath 69 under a roller 71 and then up over guide rollers 73 through the flyer and into a closing die 75. The flyer 63 is rotated by a motor 77 and the wire strand 59 on the individual bobbins 62 is passed from the reels to the closing die 75 where it is closed about the lubricated central plastic core into a twisted wire rope which is drawn through a lubricating oil bath 79 to coat the outer surface of the strands and rope with lubricant and then over a capstan 81 and onto a storage reel 83. The rope on the reel 83 may be stored in the weather for long periods without corrosion of the outer wires of the strand.

In many cases the fiber core strand 65 will have been luricated when the individual fibers were stranded, woven or braided into a core strand. In such case the passage through the heavy oil or heated grease in bath 69 will serve to ensure thorough lubrication. However, in some cases the original lubrication of the core will be deemed sufficient and passage through the bath 69 may be dispensed with. The lubricant applied will be any suitable core or wire rope lubricant well know to those skilled in the art.

As the strands 59 are drawn through the closing die 75 the plastic on and at the surface of the strand is roughened and shredded until the surface of the strand appears to be coated or covered with a thin mat of plastic fibers. Pores are also opened in the surface as the surface is shredded and abraded. These fibers together with the rough surface characteristics including the pores in the plastic appear to be responsible for the very excellent retention of lubricant upon the surface of the wire rope and for very effective sealing between the individual strands which prevents the escape of internal lubrication from the interior of the strand to the surface of the strand.

It will be understood that while the normal closing operation by which the outer strands are stranded about the core strand will be effective to roughen and shred the surface of the plastic, that other special roughening operations could be used. Such operations might for example consist of passing the stranded rope through an external abrading device of various types or even reheating the plastic at the surface of the strands and passing the stranded rope through an elastomeric wiping die.

The plastic foam can be of any suitable composition such as vinyl plastic having an organic nitrogen compound such as azodiacarbonamide as a foaming agent. This plastic when heated above the decomposition temperature of the organic nitrogen compound decomposes into nitrogen and carbon dioxide and expands the plastic into a foam. Another suitable composition would be a foamable polyurethane consisting of a thermosetting elastomer filled with expandable plastic beads. When exposed to heat the plastic of the beads softens and an entrapped gas therein expands the plastic into a foam. The polyurethane elastomer matrix provides cross linking. Any other plastic composition which is flexible, tough and adherent to metal may be used with a foaming agent to coat the strand.

Figure 4:
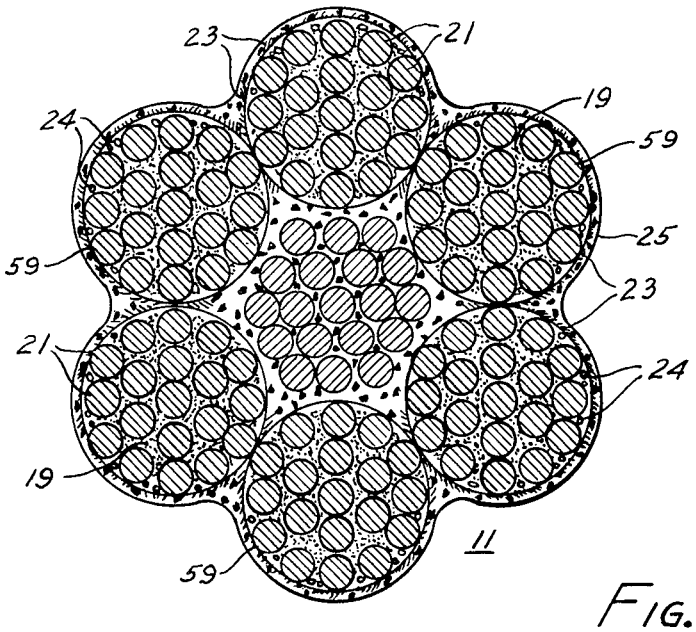
FIG. 4 is a cross sectional view of a modified rope made in accordance with the present invention.

In FIG. 4 there is shown in cross section a further embodiment of the invention in which the outer strands 59 of the rope are closed about a lubricated wire core instead of the fiber core shown in FIGS. 2 and 2B.

Figure 5:
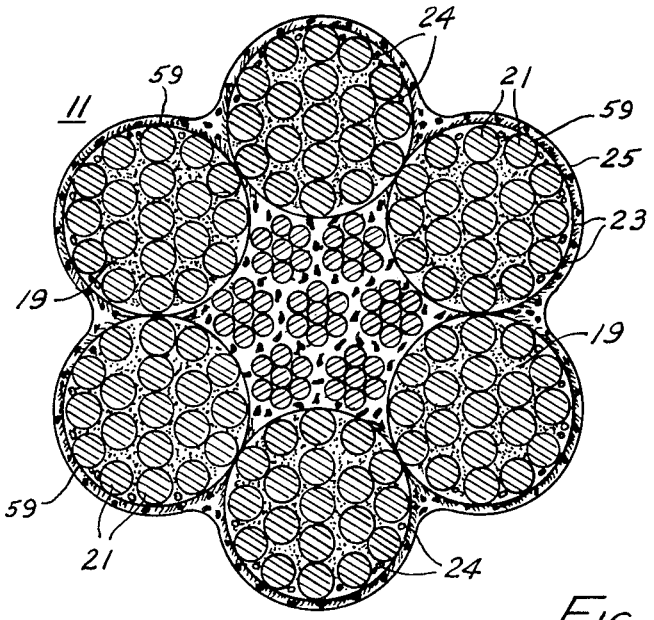
FIG. 5 is a cross sectional view of a further embodiment of a rope in accordance with the invention.

In FIG. 5 there is shown an embodiment of the invention in cross section in which the lubricated core is an independent wire rope core, or IWRC. In both FIGS. 4 and 5 the rough surface of the outer strands serves very effectively to maintain the lubricant of the core within the core. As the lubricant is forced between the strands it becomes entangled in the rough fibrous surface of the strands and is prevented from escaping while the mixture of heavy lubricant and matted plastic fibers effectively prevents any substantial penetration of sufficient water into the core to remove any significant amount of lubricant even over long periods of immersion.

Figure 6:
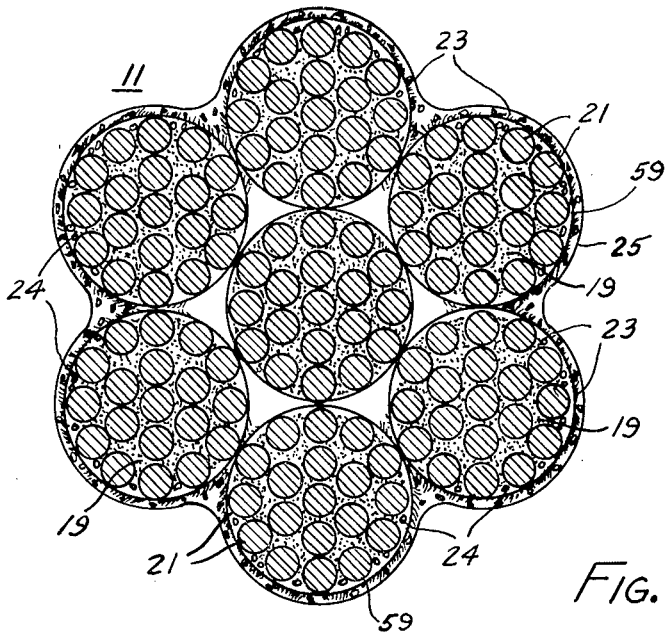
FIG. 6 is a cross sectional view of a still further embodiment of a rope in accordance with the invention.

In FIG. 6 there is shown in cross section a still further embodiment of the invention in which the central core of the rope is a foam impregnated wire strand. The same excellent surface adhesion of lubricant is attained in this strand, but no lubricant is necessary in the core. However, if desired the outside of the core may be coated with a lubricant which will then be maintained inside the rope by the fibrous surface of the outer strands. It will be understood that the foam impregnated wire core may be either a twisted wire core or an independent wire rope core.

Figure 7:
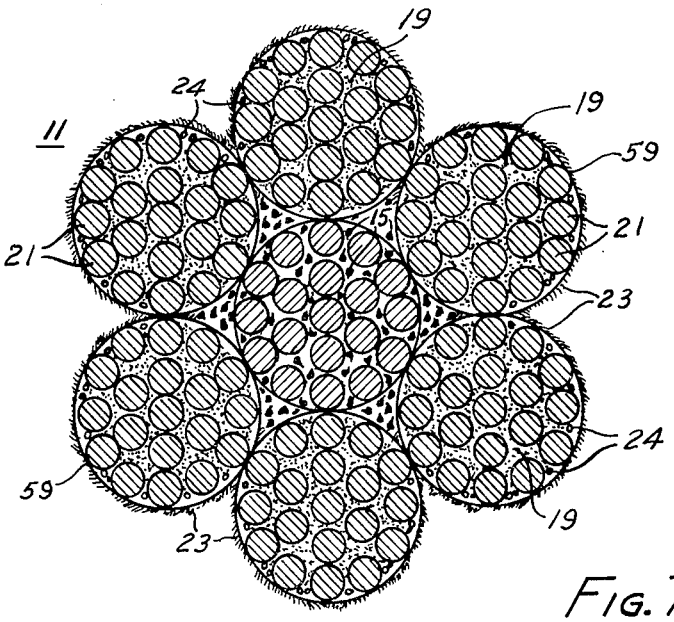
FIG. 7 is a cross sectional view of an additional embodiment of the rope of the invention.

In FIGS. 7 and 8 there are shown further embodiments of the invention similar to the embodiment shown in FIG. 4 in which the core of the rope is a lubricated wire rope core in FIG. 7 or a lubricated synthetic or sisal core in FIG. 8. As in FIG. 5 the rough surface of the outer foam filled strands serves very effectively to maintain the lubricant of the core within the core. In both embodiments shown respectively in FIGS. 7 and 8 where is no outer lubrication applied to the outer strands so that only the portions of the outer strands which are adjacent to the lubricated cores are lubricated. It is sometimes desired under modern ecological conditions to have no lubricant upon the surface of a rope which is to be used directly in a body of water in order to avoid contamination of the water by small amounts of the lubricant. In such cases it is also, of course, desirable, if a lubricated core is to be used in the rope, not to have lubricant escape from the core either. It has been found that the construction shown in FIGS. 7 and 8 is quite effective in maintaining the lubricant within the rope. The lubricant is prevented from passing between the strands by the rough surface of opposing strands which interact or interengage intimately together to prevent passage of lubricant and substantially seal the lubricant within the strand.

By the formation of a wire rope in accordance with the invention there is provided a wire rope having exceptional retention of surface lubricant and in those cases where an internal lubricant is used, of internal lubricant. The rope is economical to make and durable in service.

We claim:

1. A corrosion resistant wire rope comprising:

(a) a central core, (b) a series of foam plastic impregnated outer strands surrounding the central core, (c) each of said outer strands having a rough fibrous and porous surface as a result of an abrading operation after foaming and hardening of the plastic material, and (d) a grease-like lubricant over the exposed surface of the outer strands intermingled with the fibrous surface of the strand and contained in the surface pores of the plastic.

2. A wire rope according to claim 1 wherein the central core is comprised of a lubricated wire strand core.

3. A wire rope according to claim 1 wherein the central core is comprised of a fiber core.

4. A wire rope according to claim 1 wherein the central core is comprised of an independent wire rope core.

5. A wire rope according to claim 1 wherein the abrading operation upon the outer strands is a strand closing operation.

6. A wire rope according to claim 1 wherein the central core is impregnated with plastic foam material.

7. A method of making a corrosion resistant wire rope comprising:

(a) making a series of foamable plastic impregnated wire strands,
(b) foaming the plastic in the strands,
(c) closing said foam impregnated strands about a central core, and
(d) applying a viscous lubricant over the surface of the outer strands.

8. A wire rope comprising:
(a) a lubricated central core,
(b) a series of foam plastic impregnated outer strands surrounding the central core,
(c) each of said outer strands having a rough fibrous, porous outer surface as a result of an abrading operation after foaming and hardening of the foam plastic material, the surface of said outer strands being interengaged with adjacent outer strands in a manner such that passage of lubricant from the central core to the exterior of the rope is substantially prevented.

9. A corrosion resistant wire rope according to claim 8 wherein the abrading operation to which the outer strands are subjected is a closing operation.

10. A wire rope according to claim 8 additionally comprising:
(d) a layer of wire rope lubricant applied to the outer rough, porous outer surface of the outer strands.

* * * * *